US006505712B2

(12) United States Patent
Hattori et al.

(10) Patent No.: US 6,505,712 B2
(45) Date of Patent: Jan. 14, 2003

(54) DEVICE AND METHOD FOR CONTROL OF DOUBLE DECK ELEVATOR SYSTEM

(75) Inventors: Kazuhiro Hattori, Wakaba-ku (JP); Hideyuki Honma, Yotsukaidou (JP)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/006,099

(22) Filed: Dec. 4, 2001

(65) Prior Publication Data

US 2002/0088672 A1 Jul. 11, 2002

(30) Foreign Application Priority Data

Dec. 8, 2000 (JP) ..... 2000-373770

(51) Int. Cl.[7] ..... B66B 1/18
(52) U.S. Cl. ..... 187/382; 187/902
(58) Field of Search ..... 187/247, 248, 187/380, 382, 384, 386, 388, 389, 902

(56) References Cited

U.S. PATENT DOCUMENTS

| | | | | | |
|---|---|---|---|---|---|
| 5,844,179 | A | * | 12/1998 | Walker et al. | 187/382 |
| 5,861,587 | A | * | 1/1999 | Powell et al. | 187/249 |
| 6,176,351 | B1 | * | 1/2001 | Ikeda et al. | 187/387 |
| 6,293,368 | B1 | * | 9/2001 | Ylinen et al. | 187/382 |
| 6,334,511 | B1 | * | 1/2002 | Araki | 187/380 |
| 6,419,051 | B2 | * | 7/2002 | Mori et al. | 187/247 |
| 2002/0033306 | A1 | * | 3/2002 | Kostka et al. | 187/382 |

FOREIGN PATENT DOCUMENTS

JP 03238275 A * 10/1991 ..... B66B/1/18

* cited by examiner

*Primary Examiner*—Jonathan Salata

(57) ABSTRACT

The present invention improves the performance of the group control of elevators by shortening the waiting time for connections to the top floor in a system composed of a plurality double deck elevators having upper decks ($1a_U$)~($1e_U$) and lower decks ($1a_L$)~($1e_L$), respectively.

2 Claims, 3 Drawing Sheets

DEVICE AND METHOD FOR CONTROL OF DOUBLE DECK ELEVATOR SYSTEM

TECHNICAL FIELD OF THE INVENTION

This invention pertains to a device and method for control of a double deck elevator, which has an upper deck and a lower deck serving two adjacent floors.

BACKGROUND

Compared with the single-deck elevator, the double deck elevator system can transport many more passengers to destination floors. Consequently, it has been adopted for skyscrapers and high-capacity buildings.

A typical double deck elevator system has a plurality of elevators, each of which has an upper deck and a vertically adjacent lower deck. Information on the position and running direction of the individual cars (elevator cars), car calls, hall calls, etc., is collected from a controller on each elevator by a group controller. Based on the collected information, various control commands are output via said car controllers to the corresponding elevators.

A car call refers to the operation of destination information by a passenger using the car operating panel set on each deck of the double deck elevator system. For example, when the passenger pushes the button indicating the destination floor on the car operating panel, the destination information of the passenger on that deck of the elevator is sent to the car controller.

The hall call is made from the hall call panel set near the door on the elevator stage on each floor. Said hall call panel is composed of, for example, an upward call button and a downward call button. The passenger who needs the elevator pushes the button in the destination direction, and after entering the elevator that arrives upon the call, the passenger inputs the destination floor on the car operating panel.

For the double deck elevator, when the passenger wants to go to the top floor of the building, the passenger must enter the upper deck. If the passenger enters the lower deck, the passenger has to change to the upper deck the next to top floor in order to complete the trip via elevator. In this case, the passenger has to wait on the landing stage twice instead of once, increasing the total wait and trip time.

In the conventional case, usually, the passenger ascends from the lobby level to the next upward first floor by means of an elevator, escalator or the like, and then boards the elevator from to reach the top floor. However, at an intermediate embarkation floor, the upper deck may not respond, instead the lower deck responds. In this case, after entering the lower deck, the passenger still must change decks on the next-to-the-top floor to complete the trip via elevator.

When the passenger is forced to change decks on the next-to-the-top floor by initiating an upward hall call after exiting the lower deck, except when the timing is good and there is another upward moving elevator nearby, a very long waiting period may occur until another elevator is able to respond. On the other hand, although it is only one floor up, climbing the stairs is inconvenient, in particular for disabled persons and wheelchair users. In addition, in consideration of the group control of the elevator, as the hall call takes place twice for this single trip, the service become poorer.

As another known method for servicing the top floor, is a pseudofloor, that is, an overhead space for receiving the upper deck. The upper deck stops on the pseudofloor, while the lower deck stops on the top floor. However, in this method, it is necessary to build the hoistway one floor higher. This increases the construction cost, and an unnecessary space is formed.

As yet another method for going to the top floor, a top floor destination call button is added to the hall call panel on the departure floor (such as in the lobby or other main floor). The solution causes only the upper deck to respond to a top floor destination hall call. However, adding top floor destination call buttons on all of the floors increases the cost significantly.

The purpose of this invention is to solve the aforementioned problems of the conventional methods by providing a device and method for control of the double deck elevator characterized by the fact that it can shorten the waiting time for changing decks when the passenger wishes to go to the top floor so that the passenger can use the elevator more easily, and, at the same time, it can improve the performance of the group control of the elevator.

DISCLOSURE OF THE INVENTION

In order to solve the aforementioned problem, this invention provides a device for control of double deck elevator characterized in that the double deck elevator system has a plurality of double deck elevators, each of which has an upper deck and a lower deck for transporting passengers to two adjacent floors at the same time; this device for control has a top floor car call button set in the car operation panel of the lower deck of each of said plural elevators, and a control means which performs the following operation: when said top floor car call button is pushed, a car call is registered with an intermediate floor designated as the connecting floor, and at the same time, the arrival time for the lower deck at said connecting floor is continually predicted; when said predicted arrival time becomes shorter than a preset time due to the movement of the elevator, an upward hall call is registered at said connecting floor; when said upward hall call is registered, it is processed to find another elevator from among said plurality elevators that can arrive at said connecting floor in the shortest time; the upper deck of this chosen elevator is assigned to be the deck that should respond to said upward hall call.

In addition, this invention provides a method for control of a double deck elevator system characterized in that the method is for control of a double deck elevator system having a plurality of double deck elevators, each having an upper deck and a lower deck for serving two adjacent floors at the same time; this control method is used when a car call is made for the top floor from the lower deck of said elevator. In this control method, when the car call is made from said lower deck with the top floor as the destination floor, a car call is registered for an intermediate connecting floor, and simultaneously the time for the lower deck to arrive at said connecting floor is continually predicted; when said predicted arrival time becomes shorter than a preset time due to movement of the elevator, a hall call is processed to register an upward hall call at said connecting floor; when said upward hall call is registered, the call allotment is processed to find another elevator from among said plurality of elevators that can arrive at said connecting floor in the shortest time, and the upper deck of the chosen elevator is assigned as the deck to respond to said upward hall call.

DETAILED DESCRIPTION OF THE BEST MODE

Figures 1, 2:
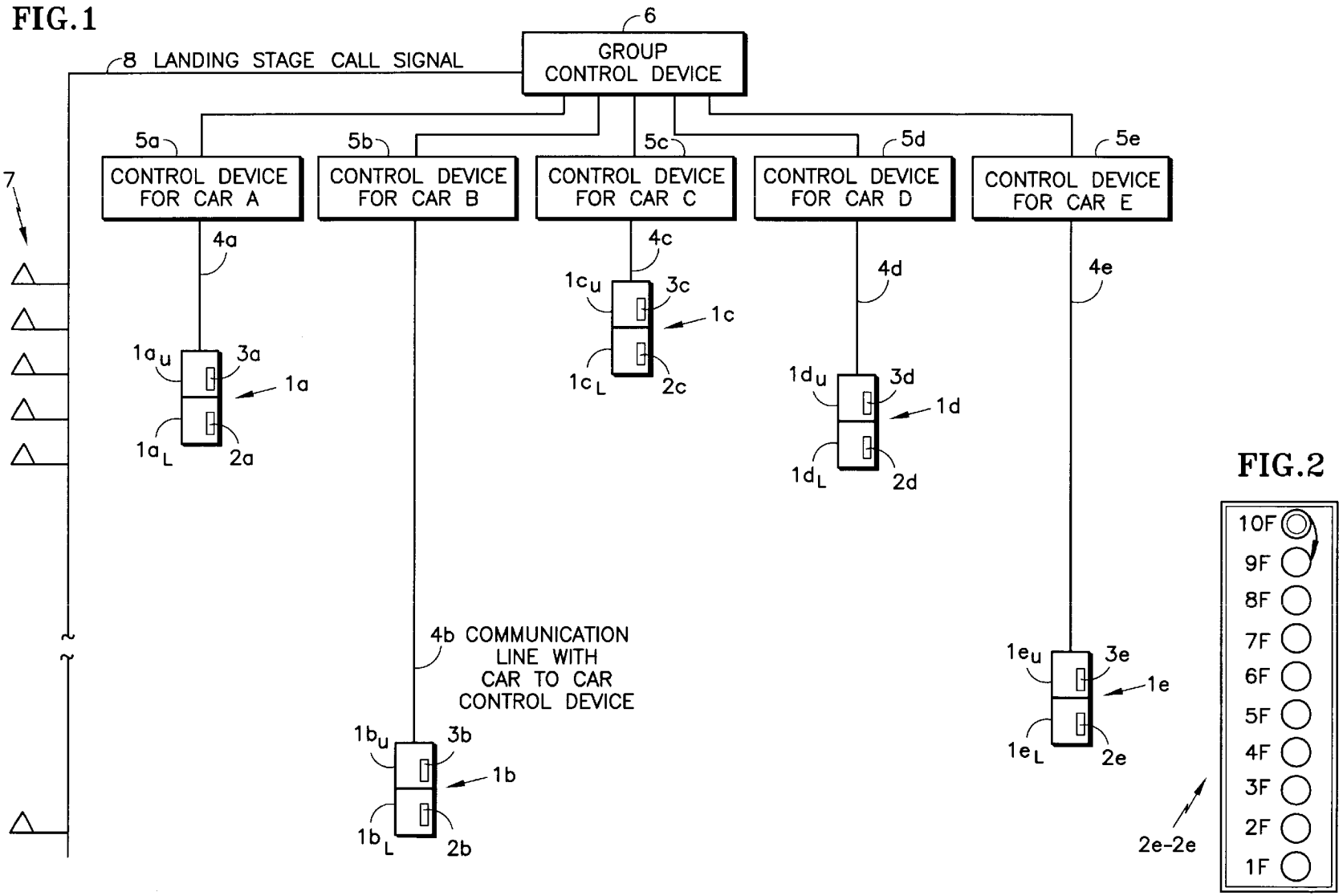
FIG. 1 is a diagram illustrating the constitution of the double deck elevator system in an embodiment of this invention.
FIG. 2 is a front view illustrating the car operating panel of the lower deck for showing the top floor car call button as the main portion in an embodiment of this invention.

In the following, an embodiment of this invention will be explained with reference to the figures. FIG. 1 is a diagram illustrating the overall constitution of the double deck elevator system of this invention. (1*a*)–(1*e*) represent the cars of the double deck elevators (elevator A~elevator E) set side by side. As shown in the figure, elevator cars (1*a*)–(1*e*) have upper decks ($1a_u$)–($1e_u$) and lower decks ($1a_L$)–($1e_L$), respectively. While not shown in the figure, the cars are driven by a motor via sheaves and ropes to move up/down in the lift channel to reach the destination floors, while weight balance is realized by means of the balancing counterweights.

As shown in FIG. 2, car call button devices (2*a*)–(2*e*), each having a top floor car call button, are set on the car operating panels inside said lower decks ($1a_L$)–($1e_L$), respectively. Car call button devices (3*a*)–(3*e*), which are the same as the conventional car call button devices, are set on the car operating panels inside upper decks ($1a_u$)–($1e_u$), respectively.

Said elevator cars (1*a*)–(1*e*) are connected to car controllers (5*a*)–(5*e*) of elevators 1(*a*)–1(*e*) by communication lines 4*a*–4*e,* respectively, and they are collectively taken as a group under group controller (6) that controls the various elevator cars of elevators 1(*a*)–1(*e*):

Panel (7) represents the elevator hall call panels set near the door of the elevator landing stage on each floor. Said elevator hall call panel (7) and group controller (6) are connected via landing stage call signal line (8).

For example, said group controller (6) has a control means made of a computer. As the normal control, an appropriate elevator is allotted corresponding to the hall call generated by said elevator hall call panel (7), and a command is issued to assign to the stand-by position the elevator for which any prior landing stage call and the car call service have ended. In addition, when a car call is operated for the top floor as the destination floor by car call button devices (2*a*)–(2*e*) on the lower deck of said elevator (when the top floor car call button is pushed to register a call), the following control is executed.

For example, suppose the top floor car call button of car call button device (2*b*) on lower deck ($1b_L$) of elevator (1*b*) is pushed: this action is registered by car controller (5*b*), the information on this action is sent by car controller (5*b*) to group controller (6). Based on this information, group controller (6) registers the car call, with an intermediate floor (such as the $9^{th}$ floor when the top floor is the $10^{th}$ floor as shown in FIG. 2) designated as the connecting floor.

Then, the time for lower deck ($1b_L$) to arrive at said connecting floor is predicted on a repeated basis. When the aforementioned predicted arrival time becomes shorter than a preset time due to the upward movement of the elevator (that is, when lower deck ($1b_L$) is nearing the connecting floor), an upward hall call is generated by the group controller for the connecting floor.

Then, this connecting floor hall call is processed to select another elevator that can arrive at said connecting floor in the shortest time from among the plurality of elevators, and the upper deck of the selected elevator is assigned to be the deck that should respond to said upward hall call.

Figure 8:
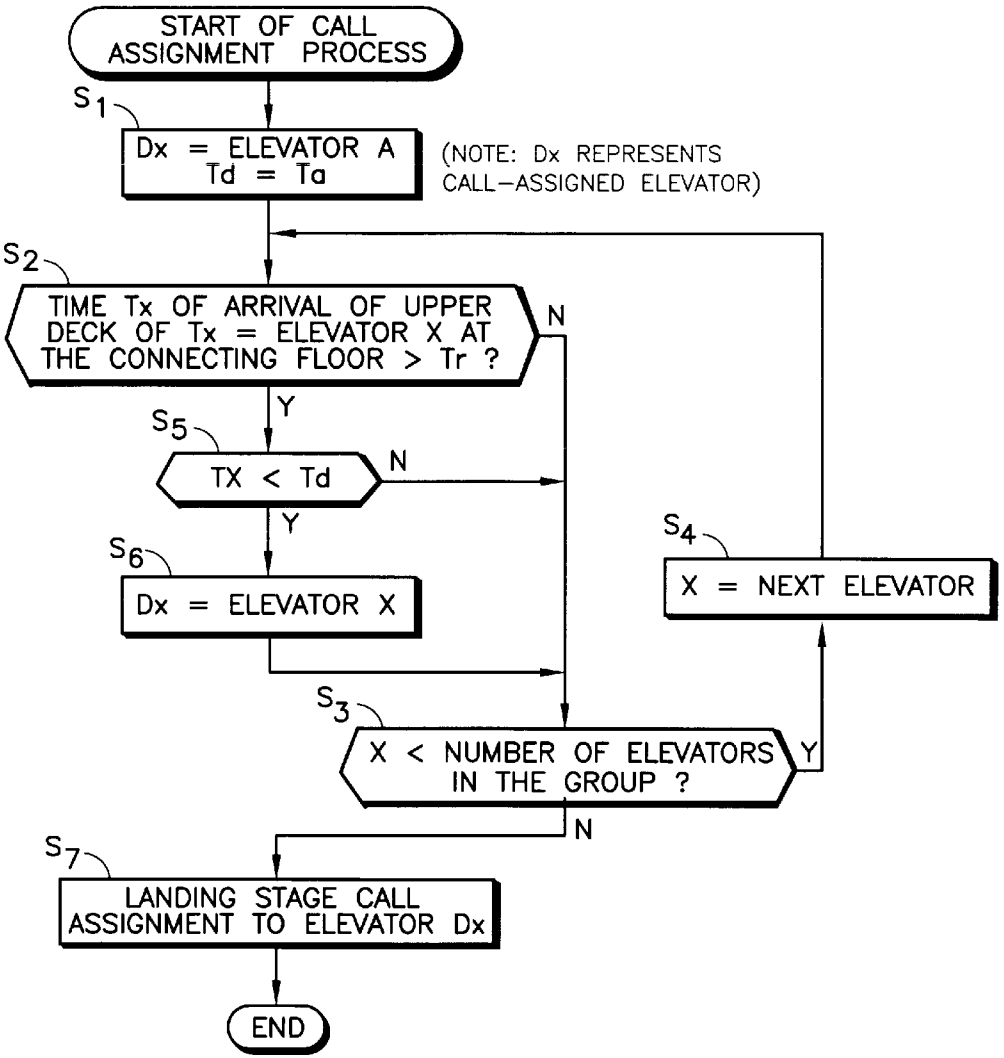
FIG. 8 is a flow chart of the call assignment process performed by the control means of this invention.

In the following, the operation of the double deck elevator system with the aforementioned constitution will be explained with reference to FIGS. 3–8. FIGS. 3–6 illustrate the state of operation of the double deck elevators shown in FIG. 1 by showing the positions of the various elevator cars. FIG. 7 is a flow chart of the call registration process performed by group controller (6). FIG. 8 is a flow chart of the call assignment process performed by group controller (6).

Figure 3:
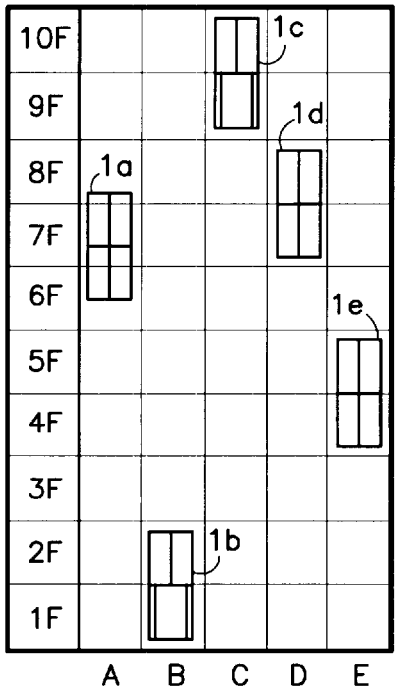
FIG. 3 is a diagram illustrating the operation state of the double deck elevator system of this invention, in the case when the lower deck of elevator B is positioned on the $1^{st}$ floor.

First of all, as shown in FIG. 3, elevator car (1*a*) of elevator A is running upward near the $7^{th}$ floor, the upper deck of elevator car (1*c*) of elevator C is stopped on the $10^{th}$ floor and its lower deck is stopped on the $9^{th}$ floor, the upper deck of elevator car (1*d*) of elevator D is stopped on the $8^{th}$ floor and its lower deck is stopped on the $7^{th}$ floor, and the upper deck of elevator car (1*e*) of elevator E is stopped on the $5^{th}$ floor and its lower deck is stopped on the $4^{th}$ floor.

In this state, passengers enter the lower deck of elevator car (1*b*) of elevator B from the landing stage on the $1^{st}$ floor, and then they register a car call, example, for the $6^{th}$ floor and the $10^{th}$ floor (the top floor) (by pushing the car call buttons of the car call button device of the lower deck).

Then, the computer of group controller (6) recognizes the registration of the aforementioned car call in step $S_1$ shown in FIG. 7, and the car call is registered as shown in FIG. 2, with the next-to-the-top floor, that is, the $9^{th}$ floor, designated as the connecting floor (step $S_2$ in FIG. 7), and it is indicated that the $9^{th}$ floor is the connecting floor. (It should be noted that any intermediate floor could equivalently serve as the connecting floor. For simplicity of description, applicants will continue to provide examples designating the next-to-the-top floor of the building as the connecting floor.)

Then, in step $S_3$ shown in FIG. 7, the time for the lower deck of elevator car (1*b*) of elevator B to arrive at said connecting floor ($9^{th}$ floor) is predicted. When the aforementioned predicted time becomes shorter than the preset time Tr due to the movement of the elevator (that is, as shown in FIG. 4, at the time when the lower deck of elevator B ascends near the $7^{th}$ floor which is near the connecting floor), as shown in FIG. 4, the upward hall call is generated (registered) by the controller 6 on the elevator call panel set in the landing stage of said connecting floor ($9^{th}$ floor) (step $S_4$ in FIG. 7).

Figure 4:
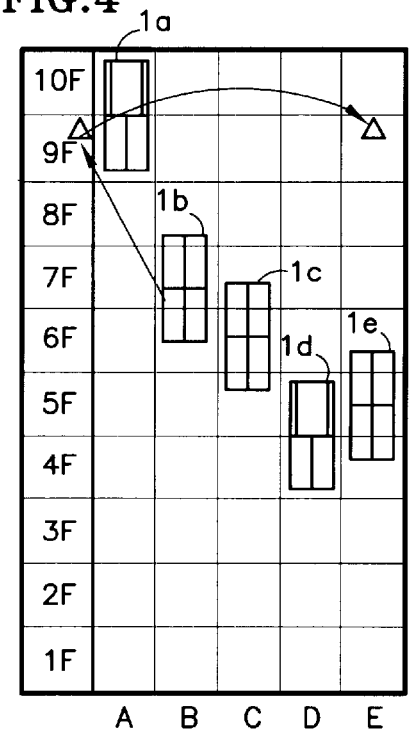
FIG. 4 is a diagram illustrating the operation state of the double deck elevator system of this invention. It shows the time when the predicted time when elevator B arrives at the $9^{th}$ floor of a 10 floor building, becomes shorter than preset time Tr due to movements of the elevator.

FIG. 4 illustrates the state when the upper deck of elevator car (1*a*) of elevator A is on the $10^{th}$ floor and its lower deck is on the $9^{th}$ floor, elevator car (1*c*) of elevator C is descending near the $6^{th}$ floor, the upper deck of elevator car (1*d*) of elevator D is on the $5^{th}$ floor and its lower deck is on the $4^{th}$ floor, and elevator car (1*e*) of elevator E is ascending near the $5^{th}$ floor.

Then, among the aforementioned plural elevators, another elevator that can arrive at said landing stage floor ($9^{th}$ floor) in the shortest time is determined according to the flow chart shown in FIG. 8, and the upper deck of the chosen elevator is assigned to be the deck that should respond to said upward hall call.

First of all, in step $S_1$ shown in FIG. 8, call-assigned elevator Dx is designated as one elevator, such as elevator A, among plural elevators, and the time Td for the upper deck of the elevator to arrive at said connecting floor ($9^{th}$ floor) is designated as time Ta when elevator A arrives (initial setting is performed).

Then, in step $S_2$, time Tx when the upper deck of elevator X arrives at the connecting floor ($9^{th}$ floor) and said preset time Tr (value of the arrival time) are compared with each other, and judgment is made on whether Tx>Tr.

When the results indicates that Tx>Tr is not true, in step $S_3$, judgment is made on whether said X is smaller than the number of elevators in the group (the number of elevators controlled by group controller (6)). When X<number of elevators in the group (when the judgment processing has not ended for all of the elevators), in step $S_4$, X is designated as the next elevator, and the judgment of said step $S_2$ is performed again.

When the judgment result of said step $S_2$ is Tx>Tr, in step $S_5$, judgment is made on whether Tx<Td. If Tx<Td is not true, said step $S_3$ is executed once again. On the other hand, when Tx<Td, in step $S_6$, call-assigned elevator Dx is designated as elevator X, and then said step $S_3$ is executed again. In step $S_5$, Td is the time when the upper deck of the elevator in the last judgment round arrives at said connecting floor ($9^{th}$ floor).

When the judgment result in step $S_3$ is that X<number of elevators in the group is not true (when the judgment process ends for all of the elevators), in step $S_7$, said elevator Dx is determined to be the elevator that can arrive at the aforementioned connecting floor in the shortest time, and the upper deck of the determined elevator is assigned to be the deck that should respond to said upward hall call (of the $9^{th}$ floor as the connecting floor).

When the result of judgment in step $S_2$ in FIG. 8 is that Tx>Tr is not true, it indicates that time Tx for the upper deck of the elevator (elevator X) now under judgment to arrive at the connecting floor ($9^{th}$ floor) is shorter than said set time Tr, that is, elevator X arrives quicker than the arrival of elevator B at the $9^{th}$ floor, and it is quite possible that when elevator B arrives, [elevator X] might have run to another floor. Consequently, in this case, the processing that designates Dx=elevator X as in step S6, that is, the processing that determines elevator X to be a candidate for the elevator that can arrive at the connecting floor in the shortest time, is not performed.

When the judgment result of step $S_2$ in FIG. 8 is Tx>Tr, while the judgment result of step $S_5$ is that Tx<Td is not true (when Tr<Tx>Td), it indicates that time Tx for the upper deck of the elevator now being judged (elevator X) to arrive at the connecting floor ($9^{th}$ floor) is longer than said preset time Tr, and it is also longer than time Td for the upper deck of the elevator that has been judged in the last round to arrive at said connecting floor ($9^{th}$ floor). That is, although elevator X arrives at the $9^{th}$ floor after elevator B arrives at the $9^{th}$ floor, it arrives later than the arrival time (Td) of the elevator judged in the last round, and the waiting time after elevator B arrives at the $9^{th}$ floor is longer. Consequently, in this case, the processing that designates Dx=elevator X as in step $S_6$, that is, the processing that determines elevator X to be a candidate for the elevator that can arrive at the connecting floor in the shortest time, is not performed.

When the judgment result of step $S_2$ in FIG. 8 is Tx>Tr, while the judgment result of step $S_5$ is that Tx<Td (when Tr<Tx<Td), it indicates that time Tx for the upper deck of the elevator now being judged (elevator X) to arrive at the connecting floor ($9^{th}$ floor) is longer than said preset time Tr, and it is shorter than time Td for the upper deck of the elevator that has been judged in the last round to arrive at said connecting floor ($9^{th}$ floor). That is, elevator X arrives at the $9^{th}$ floor after elevator B arrives the $9^{th}$ floor, and it arrives earlier than the arrival time (Td) of the elevator judged in the last round, and the waiting time after elevator B arrives at the $9^{th}$ floor is shorter. Consequently, in this case, the processing that designates Dx=elevator X as in step $S_6$, that is, the processing that determines elevator X to be a candidate for the elevator that can arrive at the connecting floor in the shortest time, is performed.

The upper deck of the candidate for the elevator that can arrive at the connecting floor in the shortest time (Dx) is assigned to be the deck that should respond to said upward landing stage call (on the $9^{th}$ floor as the connecting floor) at the time when the judgment process is completed for all of the elevators (at the time when the judgment result of step $S_3$ is that X<number of elevators of the group is not true) (step $S_7$).

That is, in the case shown in FIG. 4, the judgment result of Tx>Tr is "No" in step $S_2$ for elevators A and B, and, as elevators C and D are descending, in step $S_5$, the result of judgment of Tx<Td is "No". However, as elevator E is rising near the $5^{th}$ floor, in step $S_5$, the result of judgment of Tx<Td is "Yes."

Consequently, call-assigned elevator Dx becomes elevator E, and the upper deck of said elevator E is assigned as the deck that should respond to said upward hall call (on the $9^{th}$ floor as the connecting floor).

Figure 5:
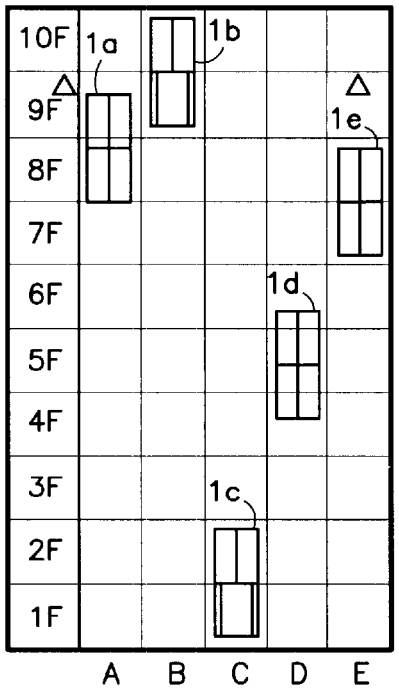
FIG. 5 is a diagram illustrating the operating state of the double deck elevator system of this invention. It shows the state when the lower deck of elevator B arrives at the $9^{th}$ floor.

Consequently, when the lower deck of elevator B arrives at the $9^{th}$ floor as the connecting floor as shown in FIG. 5, as the upward hall call has been assigned to the upper deck of elevator E, there is no need for the passenger to push the hall call button again on the $9^{th}$ floor (to push the button of the elevator call panel set in the landing stage on the $9^{th}$ floor to generate an upward hall call), and the upper deck of elevator E is in a state that allows it to immediately arrive at the $9^{th}$ floor (that is, it is present on the $8^{th}$ floor).

Figure 6:
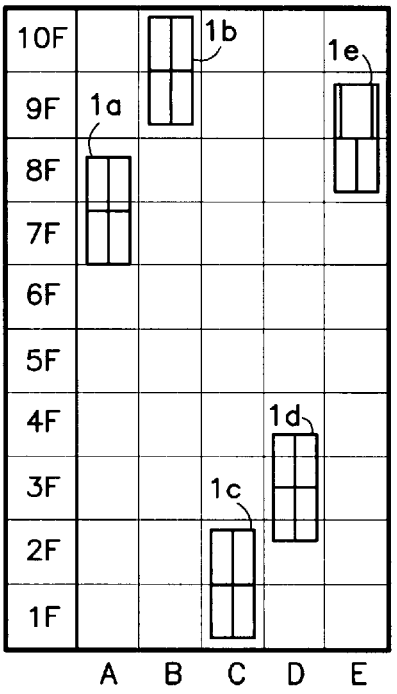
FIG. 6 is a diagram illustrating the operating state of the double deck elevator system of this invention. It shows the state when the upper deck of elevator E with upward hall call assigned to it arrives at the $9^{th}$ floor.
Figure 7:
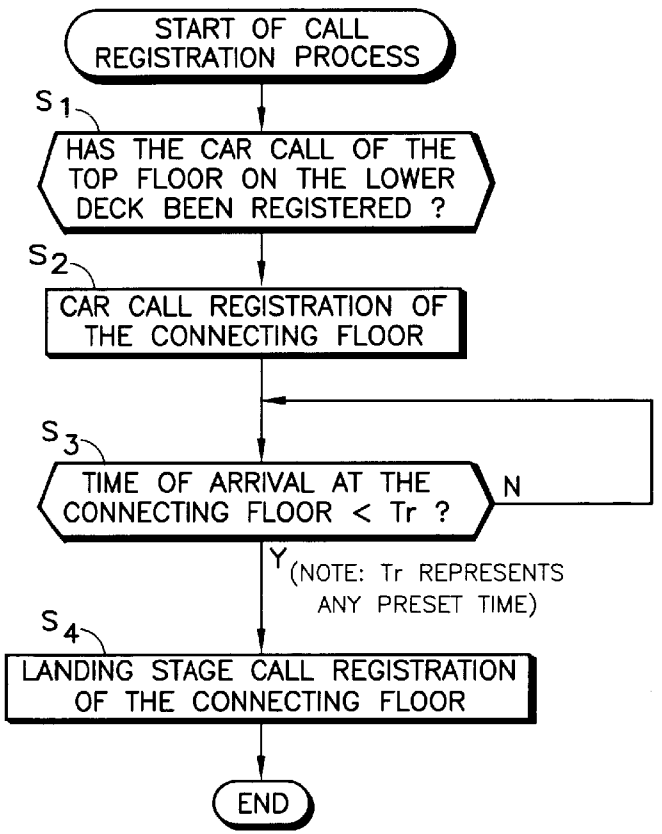
FIG. 7 is a flow chart of the call registration process performed by the control means of this invention.

Consequently, as shown in FIG. 6, the upper deck of elevator E arrives at the $9^{th}$ floor with little waiting time, and the passengers on the lower deck of elevator B can make a smooth change and to go to the top floor.

The number of elevators of the double deck elevator system and the number of floors are not limited to those in the aforementioned embodiment.

As explained above, according to this invention, in the double deck elevator system, the waiting time for going to the top floor can be significantly shortened. Consequently, it is very convenient for passengers. In particular, for disabled persons and wheelchair users, this is much preferable to climbing the stairs.

For building managers, it is possible to predict generation of calls. That is, at the time when the car call button for the top floor is pushed, the group controller can predict generation of the upward hall call on the connecting floor. Consequently, the group control performance of elevators can be improved, and as a result, the service is improved for users as a whole.

There is no need to set a pseudofloor as a space to receive the upper deck above the top floor. As a result, the construction cost is cut, and there is no wasteful space generated.

There is no need to set a destination floor call button on all floors. As a result, the construction cost can be further cut.

What is claimed is:

1. Control device for a double deck elevator system having a plurality of double deck elevators each elevator having an upper deck and a lower deck for serving two adjacent floors at the same time, characterized in that said elevator system includes:

a top floor car call button disposed in the car operating panel of the lower deck of each of said elevators, and a control means which performs the following operation: when said top floor car call button is pushed, a car call is registered with the floor below the top floor designated as the connecting floor, and at the same time, the time for the lower deck to arrive at said connecting floor is predicted; when the aforementioned predicted arrival time is shorter than a preset time due to driving of the elevator, the upward landing stage call is registered at the aforementioned connecting floor; when the aforementioned upward landing stage call is registered, it is processed to find another elevator from among the aforementioned plural elevators that can arrive at said embarking floor in the shortest time; the upper deck of this chosen elevator is assigned to be the deck to respond to the aforementioned upward landing stage call.

2. A method for control of a double deck elevator system characterized by the following facts: the method is for control of a double deck elevator system, which has plural double deck elevators each having an upper deck and a lower deck for transporting to two adjacent floors at the same time; and comprises the steps of:

executing said control method responsive to a car call operation performed from the lower deck of said elevator with the top floor designated as the destination floor; and registering a car call with an intermediate floor below the top floor designated as the connecting floor, and at the same time, predicting the time for the lower deck to arrive at said connecting floor; and when said predicted arrival time becomes shorter than a preset time due to movement of the elevator, processing the call registration to register an upward hall call at said connecting floor; and processing, responsive to said upward hall call, call is registered, call allotment is processed to find another elevator from among said plural elevators that can arrive at said connecting floor in the shortest time, and assigning the upper deck of this chosen elevator as the deck that should respond to said upward hall call.

* * * * *